US007770884B2

(12) United States Patent
Clark et al.

(10) Patent No.: US 7,770,884 B2
(45) Date of Patent: Aug. 10, 2010

(54) METHOD AND APPARATUS FOR FLUFF MANAGEMENT IN AN IMAGE PRODUCTION DEVICE

(75) Inventors: Robert Alan Clark, Williamson, NY (US); Lloyd Williams, Mahopac, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/187,930

(22) Filed: Aug. 7, 2008

(65) Prior Publication Data

US 2010/0032892 A1 Feb. 11, 2010

(51) Int. Cl.
*B65H 3/46* (2006.01)

(52) U.S. Cl. ..... 271/105; 271/97; 271/98

(58) Field of Classification Search ..... 271/97, 271/98, 105; 414/795.5; 382/112, 141
See application file for complete search history.

(56) References Cited

U.S. PATENT DOCUMENTS

| | | | | |
|---|---|---|---|---|
| 4,397,459 | A * | 8/1983 | Silverberg et al. | 271/94 |
| 5,048,813 | A * | 9/1991 | Wierszewski et al. | 271/98 |
| 5,098,077 | A * | 3/1992 | Russel | 271/3.13 |
| 5,290,023 | A * | 3/1994 | Sasaki et al. | 271/20 |
| 5,356,127 | A * | 10/1994 | Moore et al. | 271/11 |
| 6,264,188 | B1 * | 7/2001 | Taylor et al. | 271/98 |
| 6,279,896 | B1 * | 8/2001 | Linder et al. | 271/98 |
| 6,726,200 | B2 * | 4/2004 | Gohl et al. | 271/97 |
| 7,575,231 | B2 * | 8/2009 | Sasaki et al. | 271/98 |
| 2004/0100013 | A1 * | 5/2004 | Mathewson | 271/98 |
| 2005/0040584 | A1 * | 2/2005 | Isemura | 271/97 |
| 2006/0175746 | A1 * | 8/2006 | Adachi | 271/97 |
| 2007/0069446 | A1 * | 3/2007 | Lamendola et al. | 271/98 |
| 2007/0262513 | A1 * | 11/2007 | Fukusaka | 271/98 |

FOREIGN PATENT DOCUMENTS

JP 05306045 A * 11/1993

OTHER PUBLICATIONS

AMIS-710600-A8: 600dpi CIS Module Data Sheet; AMI Semiconductor; Jul. 6, 2008.

* cited by examiner

*Primary Examiner*—Richard W Ridley
*Assistant Examiner*—Jeremy Severson
(74) *Attorney, Agent, or Firm*—Ronald E. Prass, Jr.; Prass LLP

(57) ABSTRACT

A method and apparatus for fluff management in an image production device is disclosed. The method may include fluffing a stack of media with a predetermined amount of air flow, sensing sheet separation in the media stack, determining if the sheet separation meets predetermined criteria, wherein if the sheet separation does not meet the predetermined criteria, adjusting the air flow used for fluffing the media stack.

18 Claims, 6 Drawing Sheets

METHOD AND APPARATUS FOR FLUFF MANAGEMENT IN AN IMAGE PRODUCTION DEVICE

BACKGROUND

Disclosed herein is a method for fluff management in an image production device, as well as corresponding apparatus and computer-readable medium.

One of the more challenging aspects of high speed vacuum corrugated feeder technology is assuring the reliable separation of individual sheets of media away from the media stack. This process is initiated via the use of a media fluffing system. The conventional approach is to spend considerable time developing a media fluffing system which is robust enough to handle in an open-loop fashion all sheets of media within the product specification. Since there is no conventional method for gauging the effectiveness of the media fluffing system in real time, it can take several months to a couple of years worth of testing to refine the fluffing system to assure reliable feeder operation

SUMMARY

A method and apparatus for fluff management in an image production device is disclosed. The method may include fluffing a stack of media with a predetermined amount of air flow, sensing sheet separation in the media stack, determining if the sheet separation meets predetermined criteria, wherein if the sheet separation does not meet the predetermined criteria, adjusting the air flow used for fluffing the media stack.

DETAILED DESCRIPTION

Figure 1:
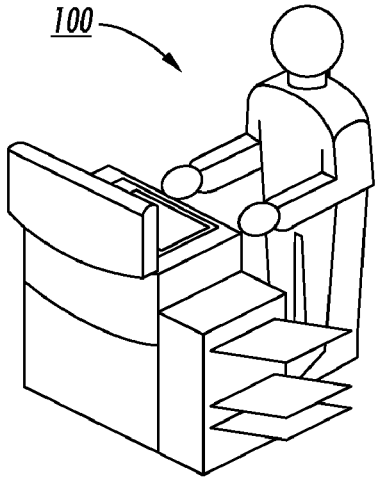
FIG. 1 is an exemplary diagram of an image production device in accordance with one possible embodiment of the disclosure.

Aspects of the embodiments disclosed herein relate to a method for fluff management in an image production device, as well as corresponding apparatus and computer-readable medium.

The disclosed embodiments may include a method for fluff management in an image production device. The method may include fluffing a stack of media with a predetermined amount of air flow, sensing sheet separation in the media stack, determining if the media separation meets predetermined criteria, wherein if the sheet separation does not meet the predetermined criteria, adjusting the air flow used for fluffing the media stack.

The disclosed embodiments may further include a fluff management unit for use in an image production device that may include a fluffer that fluffs a stack of media in the image production device with a predetermined amount of air flow, a fluff sensor that senses separation of sheets of media in the media stack, and a fluff controller that determines if the sheet separation meets predetermined criteria, wherein if the fluff controller determines that the sheet separation does not meet the predetermined criteria, the fluff controller adjusts the air flow used for fluffing the media stack.

The disclosed embodiments may further include a computer-readable medium storing instructions for controlling a computing device for fluff management in an image production device. The instructions may include fluffing a stack of media with a predetermined amount of air flow, sensing sheet separation in the media stack, determining if the sheet separation meets predetermined criteria, wherein if the sheet separation does not meet the predetermined criteria, adjusting the air flow used for fluffing the media stack.

The disclosed embodiments may concern a fluff management unit and process that may be used in conjunction with a vacuum corrugated feeder (VCF). A typical top VCF has four major functional areas. The first function may be handled by the media elevator, which maintains the top of the media stack at a set distance from the bottom of the feedhead. The media fluffing system may then fluff the top several sheets on the stack so that air can readily flow underneath the top sheet as it is acquired by the feedhead. The acquisition function may be handled by the feedhead, with a vacuum system providing the necessary uplift force needed to adhere the top sheet to the feedhead. Finally, the separation function may be enabled both by the feedhead and the air knife.

When the feedhead's corrugation pattern corrugates the top sheet, air gaps may be created between the top sheet and any other acquired sheets. An air knife may then direct air into these gaps, forcing any other acquired sheets back onto the stack. At this point, the sheet may be transported to the first roller pairs in the media path (also known as take-away rolls) via feed belts or a shuttling feedhead, and the sheet enters the media path.

The primary reliability driver for VCFs is the consistency of sheet separation while the top of the stack is being fluffed. If there is good sheet separation at this point, it is very unlikely that a feeder shutdown event (e.g., misfeed, multi-feed, etc.) will occur. If, however, the sheets clump together while being fluffed, the odds of an event occurring increase dramatically. This is especially true of high speed (120 ppm and higher) VCFs, where there is precious little time available for the separation function to compensate for poorly fluffed media.

The VCFs media fluffing system requires a significant amount of development work to reliably fluff all media typically covered in a product specification. This is principally due to the fact that there is no conventional process to monitor the state of the fluffed media stack, and as a result it is necessary to spend several months to two years to refine the fluffer system to assure reliable performance across all required media and environmental conditions.

This disclosure concerns using linear optical array sensor technology (e.g., CCD, CMOS, etc.) to scan the edges of fluffed sheets in an image production device. In conventional systems, if the performance of the fluffing system is marginal, the sheets may either fluff in clumps of several sheets or not at all. According to the disclosed embodiments, since the position of each sensor pixel may be known, the top sheet location and rough size and location of any clumps may be identified. This information may then be used by a fluff controller to adjust the fluffer operating parameters (e.g., static pressure, air burst) as needed to break the sheets back up. Using a fluff sensor to close the fluffer system control loop may result in enhanced vacuum corrugated feeder robustness as well as reduced development time.

FIG. 1 is an exemplary diagram of an image production device 100 in accordance with one possible embodiment of the disclosure. The image production device 100 may be any device that may be capable of making image production documents (e.g., printed documents, copies, etc.) including a copier, a printer, a facsimile device, and a multi-function device (MFD), for example.

Figure 2:
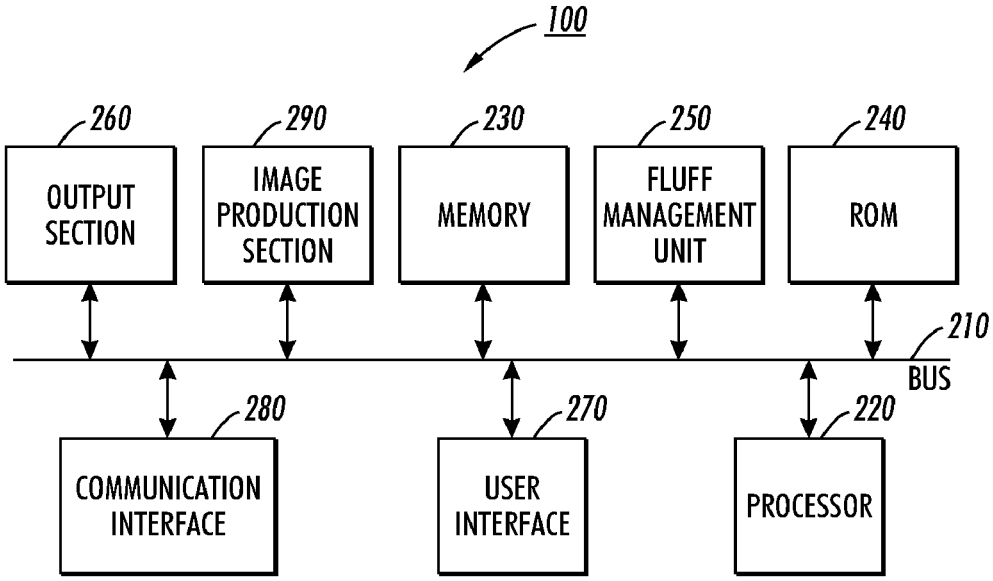
FIG. 2 is a exemplary block diagram of the image production device in accordance with one possible embodiment of the disclosure.

FIG. 2 is an exemplary block diagram of the image production device 100 in accordance with one possible embodiment of the disclosure. The image production device 100 may include a bus 210, a processor 220, a memory 230, a read only memory (ROM) 240, a fluff management unit 250, an output section 260, a user interface 270, a communication interface 280, and an image production section 290. Bus 210 may permit communication among the components of the image production device 100.

Processor 220 may include at least one conventional processor or microprocessor that interprets and executes instructions. Memory 230 may be a random access memory (RAM) or another type of dynamic storage device that stores information and instructions for execution by processor 220. Memory 230 may also include a read-only memory (ROM) which may include a conventional ROM device or another type of static storage device that stores static information and instructions for processor 220.

Communication interface 280 may include any mechanism that facilitates communication via a network. For example, communication interface 280 may include a modem. Alternatively, communication interface 280 may include other mechanisms for assisting in communications with other devices and/or systems.

ROM 240 may include a conventional ROM device or another type of static storage device that stores static information and instructions for processor 220. A storage device may augment the ROM and may include any type of storage media, such as, for example, magnetic or optical recording media and its corresponding drive.

User interface 270 may include one or more conventional mechanisms that permit a user to input information to and interact with the image production unit 100, such as a keyboard, a display, a mouse, a pen, a voice recognition device, touchpad, buttons, etc., for example. Output section 260 may include one or more conventional mechanisms that output image production documents to the user, including output trays, output paths, finishing section, etc., for example. The image processing section 290 may include an image printing and/or copying section, a scanner, a fuser, etc., for example.

The image production device 100 may perform such functions in response to processor 220 by executing sequences of instructions contained in a computer-readable medium, such as, for example, memory 230. Such instructions may be read into memory 230 from another computer-readable medium, such as a storage device or from a separate device via communication interface 280.

The image production device 100 illustrated in FIGS. 1-2 and the related discussion are intended to provide a brief, general description of a suitable communication and processing environment in which the disclosure may be implemented. Although not required, the disclosure will be described, at least in part, in the general context of computer-executable instructions, such as program modules, being executed by the image production device 100, such as a communication server, communications switch, communications router, or general purpose computer, for example.

Generally, program modules include routine programs, objects, components, data structures, etc. that perform particular tasks or implement particular abstract data types. Moreover, those skilled in the art will appreciate that other embodiments of the disclosure may be practiced in communication network environments with many types of communication equipment and computer system configurations, including personal computers, hand-held devices, multi-processor systems, microprocessor-based or programmable consumer electronics, and the like.

The operation of the fluff management unit 250 will be discussed in relation to the block diagram in FIG. 3.

Figure 3:
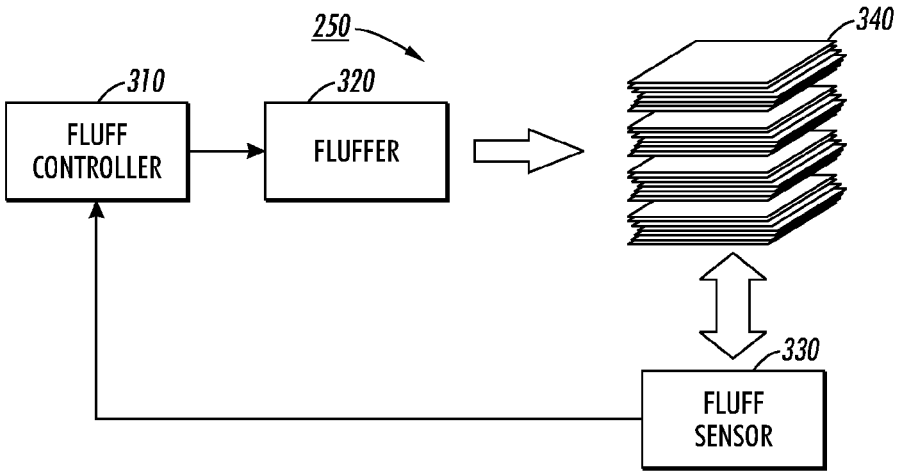
FIG. 3 is a exemplary block diagram of the fluff management unit in accordance with one possible embodiment of the disclosure.

FIG. 3 is an exemplary block diagram of the fluff management unit 250 in accordance with one possible embodiment of the disclosure. The fluff management unit 250 may manage the fluffing of the media stack 340 and may include a fluff controller 310, a fluffer 320, and a fluff sensor 330. While the term a media stack 340 is used for ease of discussion, the media stack 340 may represent any type of media used to produce documents in the image production device 100, such as any type of paper, plastic, photo paper, cardboard, etc.

The fluff controller 310 may include at least one conventional processor or microprocessor that interprets and executes instructions for controlling the functions of the fluff management unit 250. The functions of the fluff controller 310 may also be performed by the processor 220 of the image production device 100, for example. The fluffer 320 may be any mechanism known to those of skill in the art that may be used to inject air into a media stack 340 in order to provide separation between sheets of media in the stack 340.

The fluff sensor 330 may be a linear optical sensor, a charge couple device (CCD) sensor, or Complementary Metal Oxide Semiconductor (CMOS) sensor, for example.

Figure 5A:
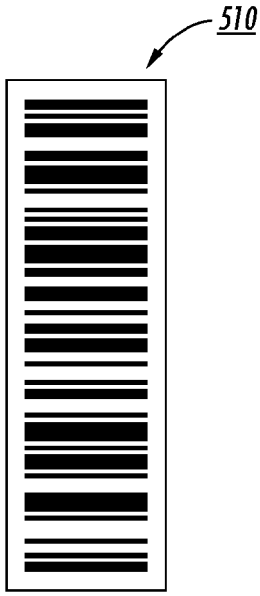
FIGS. 5A and 5B are diagrams of an exemplary bar code and a fluffed media stack, respectively, in accordance with one possible embodiment of the disclosure.
Figure 5B:
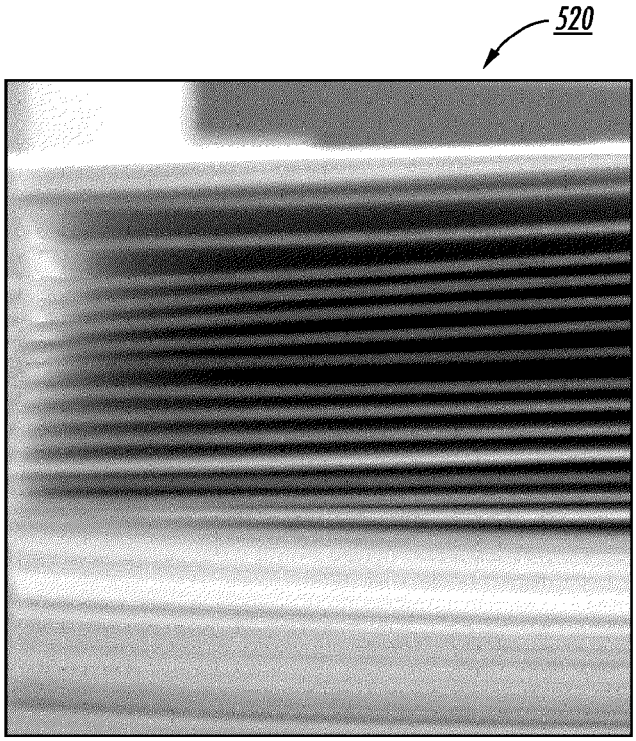

FIGS. 5A and 5B are diagrams of an exemplary bar code and a fluffed media stack, respectively, in accordance with one possible embodiment of the disclosure. For many years, bar code scanners have been used to streamline the data entry process involved with both the purchasing of and shipping of various goods and material. Virtually all grocery stores now use bar code scanners to increase checkout clerk productivity and to minimize data entry errors.

A typical bar code is shown in FIG. 5A. FIG. 5B shows a side view picture of a fluffed media stack 340. As can be seen, there are definite similarities between the bar code and a fluffed media stack 340. Thus, the fluff sensor 330 may incorporate bar code sensor technology and may be used to detect the integrity of a fluffing operation. In particular, the fluff sensor 330 may be able to determine if a group of sheets are clumped together. The fluff controller 310 may then be able to direct the fluffer 320 to take corrective action by increasing air flow in some manner.

The operation of components of the fluff management unit 250 and the fluff management process will be discussed in relation to the flowchart in FIG. 4.

Figure 4:
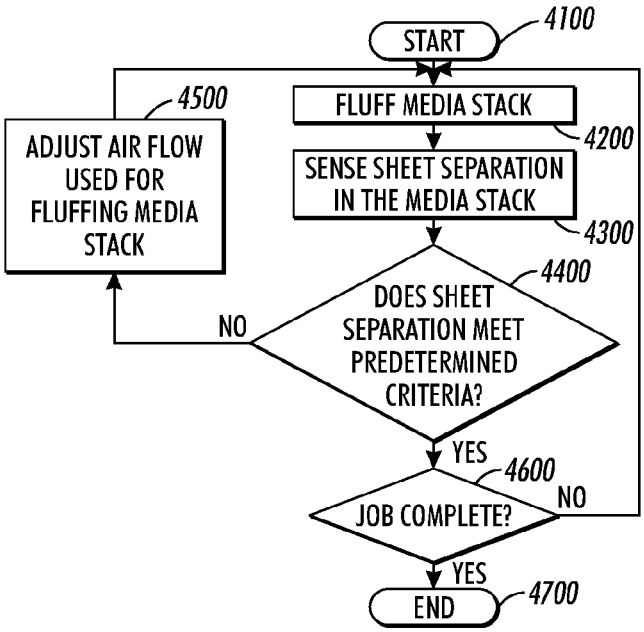
FIG. 4 is a flowchart of an exemplary fluff management process in accordance with one possible embodiment of the disclosure.

FIG. 4 is a flowchart of a fluff management process in accordance with one possible embodiment of the disclosure. The method begins at 4100, and continues to 4200 where the fluffer 320 may fluff a stack of media 340 in the image production device 1000 with a predetermined amount of air flow. At step 4300, the fluff sensor 330 may sense the separation of sheets of media in the media stack 340. The sensing of sheet separation may be performed by measuring one of gaps between sheets of media in the media stack or the thickness of the sheets of media in the media stack, for example.

At step 4400, the fluff controller 310 may determine if the sheet separation meets predetermined criteria. The predetermined criteria may be the number of sensor pixels per sheet of media, for example. As the pixel-to-pixel distance is known, the number of sensor pixels per sheet of media can then be used to calculate the sheet thickness. Should the calculated thickness of a given fluffed sheet be substantially greater than the thickness of other fluffed sheets, the given fluffed sheet may actually represent a group of sheets clumped together. If the fluff controller 310 determines that the sheet separation does not meet the predetermined criteria, then at step 4500 the fluff controller 310 adjusts the air flow used for fluffing the media stack 340. The air flow adjustment may be one of an increase in air pressure or a burst of air, for example. The process then returns to step 4200.

If at step 4400, the fluff controller 310 determines that the sheet separation meets the predetermined criteria, then the process goes to step 4600 where the fluff controller 310 determines whether the print job is complete. If the fluff controller 310 determines that the print job is not complete, the process returns to step 4200. If the fluff controller 310 determines that the print job is complete, the process may then go to step 4700 and end.

Figure 6:
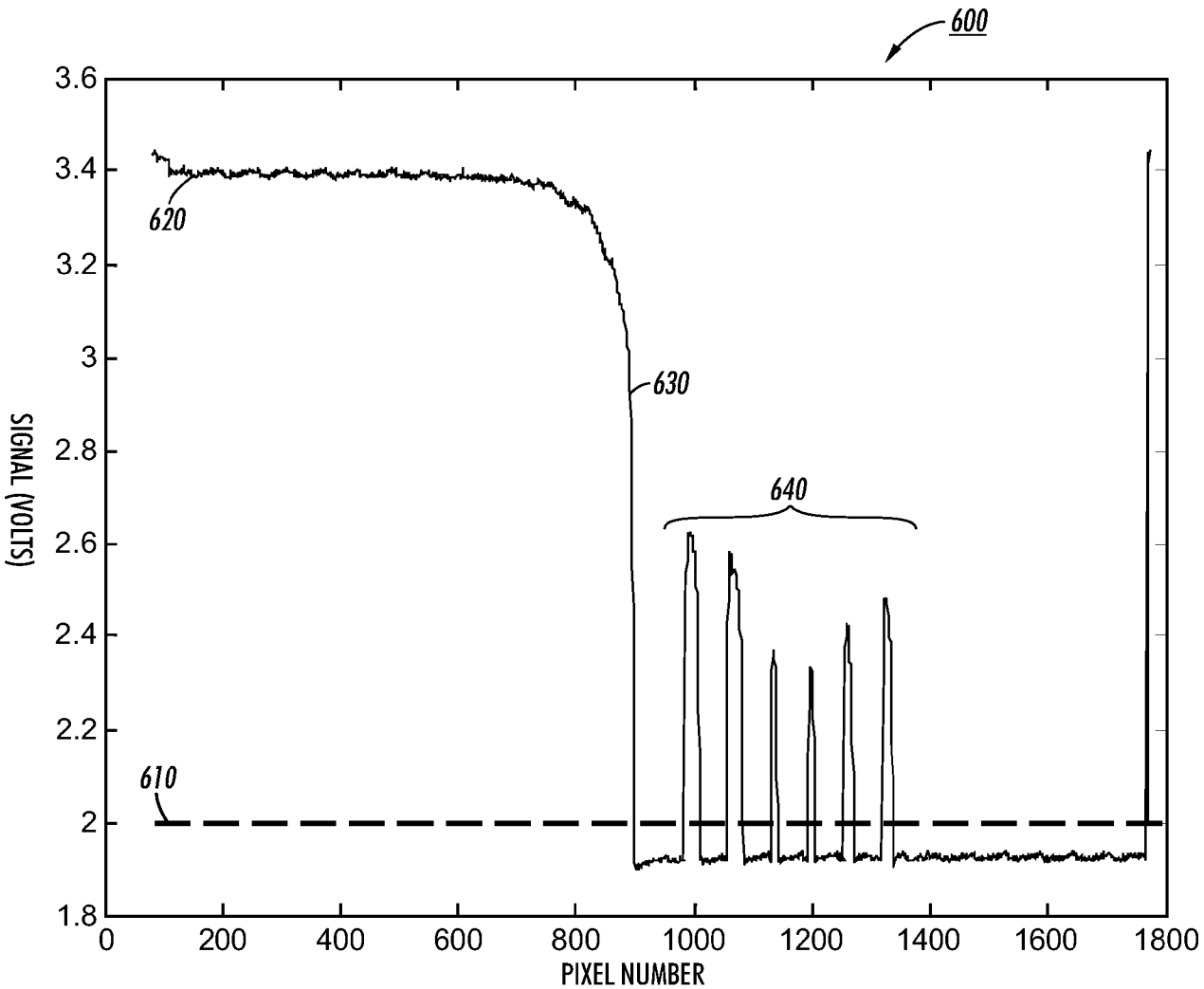
FIG. 6 is a graph illustrating the analog signal from the sensor in accordance with one possible embodiment of the disclosure.

FIG. 6 is a graph 600 illustrating an analog signal from the fluff sensor 330 in accordance with one possible embodiment of the disclosure. The signal threshold 610 is illustrated at approximately 2 volts. The portion of the graph 620 indicates the area above the media stack 340. The fluff sensor 330 detects the top sheet 630 and the gaps between the sheets and thickness of the sheets may be detected in the area 640.

Figure 7A:
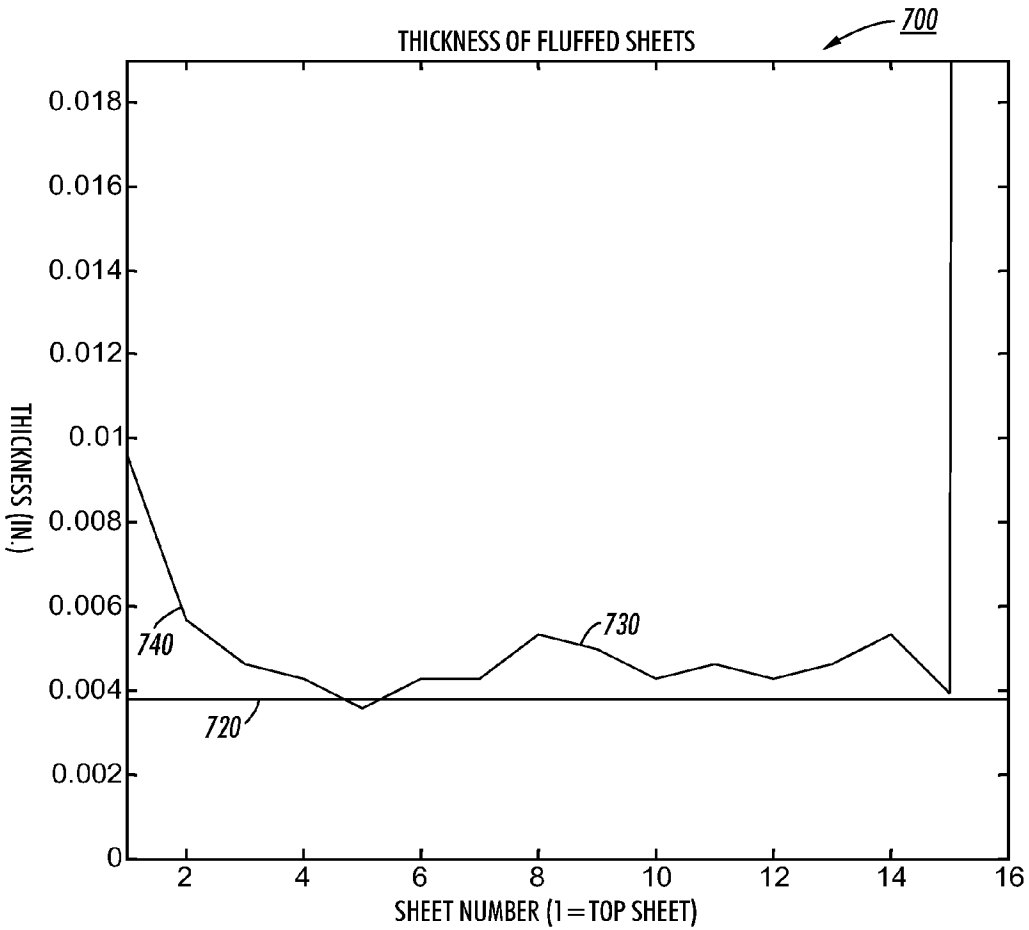
FIGS. 7A and 7B are graphs illustrating the thickness of fluffed sheets and widths between the fluffed sheets, respectively, in accordance with one possible embodiment of the disclosure.
Figure 7B:
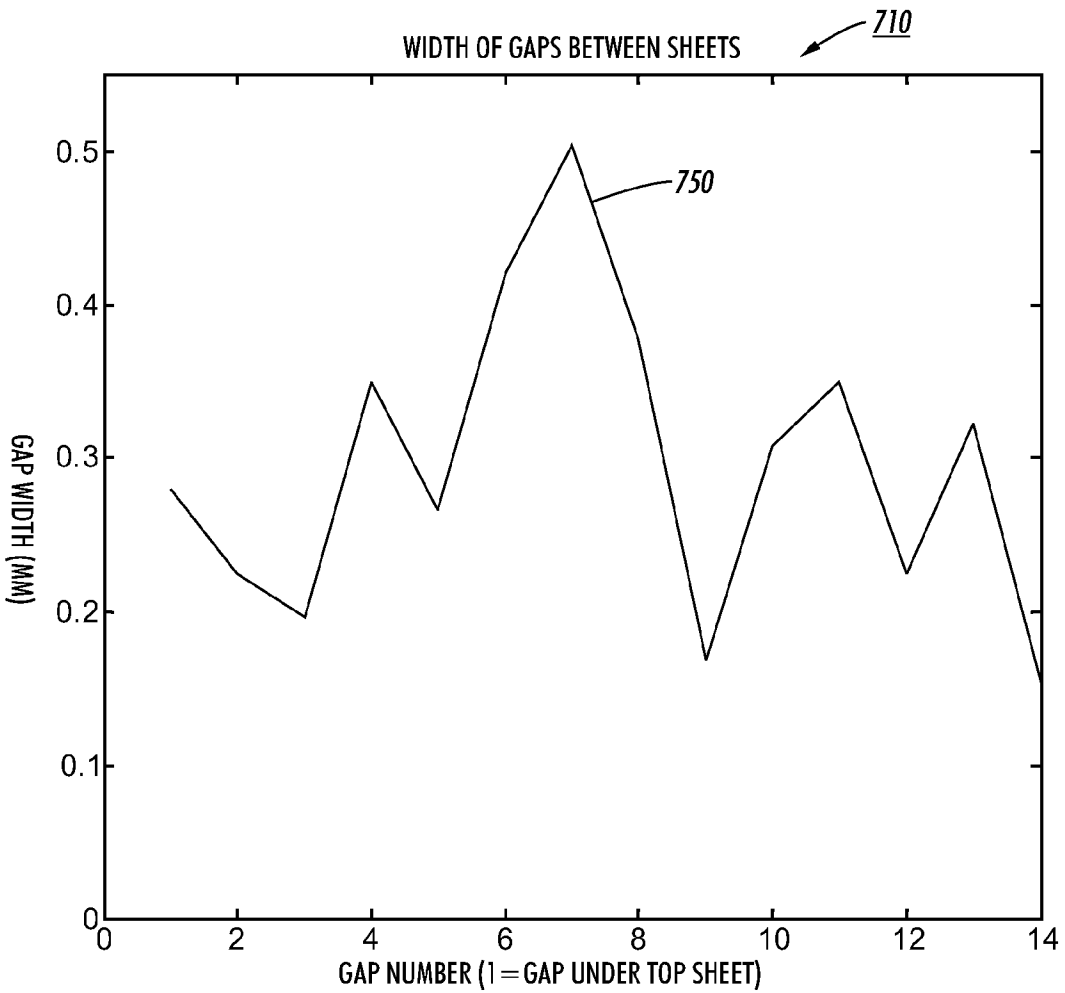

FIGS. 7A and 7B are graphs 700, 710 illustrating the thickness of fluffed sheets and widths between the fluffed sheets, respectively, in accordance with one possible embodiment of the disclosure. In FIG. 7A, the actual sheet thickness 720 is shown to be 0.0038 inches, for example. The line 730 indicates that the fluffed sheets are of constant thickness from the 4th to the 14th sheet. However, there appears to be a larger thickness around the 2nd sheet in the media stack 340 that may indicate that clumping of sheets has occurred which may cause misfeeds in the image production device 100.

FIG. 7B is a graph illustrating gaps between the sheets in the media stack 340. As shown, the large gap between the 6th and 8th sheets may indicate that clumping of sheets has occurred. Thus, in the instances illustrated by FIGS. 7A and 7B, the fluff controller 310 may receive these indications from the fluff sensor 330 and may direct the fluffer 330 to adjust air flow to the media stack 340 to avoid the clumping of media and the subsequent malfunction of the image production device 100.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hard-wired, wireless, or combination thereof to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein. It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for fluff management in an image production device, comprising:

fluffing a stack of media with a predetermined amount of air flow;

sensing sheet separation in the media stack;

determining if the sheet separation meets predetermined criteria, the predetermined criteria being a number of sensor pixels per sheet of media, wherein if the sheet separation does not meet the predetermined criteria, adjusting the air flow used for fluffing the media stack.

2. The method of claim 1, further comprising:

determining if a print job is complete, wherein if the print job is complete, stopping the air flow to the media stack.

3. The method of claim 1, wherein sensing is performed by one of a linear-optical sensor, a charge-coupled device sensor, and a Complementary Metal Oxide Semiconductor sensor.

4. The method of claim 1, wherein the air flow adjustment is one of an increase in air pressure and a burst of air.

5. The method of claim 1, wherein sensing the sheet separation is performed by measuring one of gaps between sheets of media in the media stack and thickness of the sheets of media in the media stack.

6. The method of claim 1, wherein the image production device is one of a copier, a printer, a facsimile device, and a multi-function device.

7. A fluff management unit for use in an image production device, comprising:

a fluffer that fluffs a stack of media in the image production device with a predetermined amount of air flow;

a fluff sensor that senses separation of sheets of media in the media stack; and a fluff controller that determines if the sheet separation meets predetermined criteria, the predetermined criteria being a number of sensor pixels per sheet of media, wherein if the fluff controller determines that the sheet separation does not meet the predetermined criteria, the fluff controller adjusts the air flow used for fluffing the media stack.

8. The fluff management unit of claim 7, wherein the fluff controller determines if a print job is complete, wherein if the fluff controller determines that the print job is complete, the fluff controller stops the air flow to the media stack.

9. The fluff management unit of claim 7, wherein the fluff sensor is one of a linear-optical sensor, a charge-coupled device sensor, and a Complementary Metal Oxide Semiconductor sensor.

10. The fluff management unit of claim 7, wherein the air flow adjustment is one of an increase in air pressure and a burst of air.

11. The fluff management unit of claim 7, wherein the fluff sensor senses the sheet separation by measuring one of gaps between sheets of media in the media stack and thickness of the sheets of media in the media stack.

12. The fluff management unit of claim 7, wherein the image production device is one of a copier, a printer, a facsimile device, and a multi-function device.

13. A computer-readable medium storing instructions for controlling a computing device for fluff management in an image production device, the instructions comprising:

fluffing a stack of media with a predetermined amount of air flow;

sensing sheet separation in the media stack;

determining if the sheet separation meets predetermined criteria, the predetermined criteria being a number of sensor pixels per sheet of media, wherein if the sheet separation does not meet the predetermined criteria, adjusting the air flow used for fluffing the media stack.

14. The computer-readable medium of claim 13, further comprising:

determining if a print job is complete, wherein if the print job is complete, stopping the air flow to the media stack.

15. The computer-readable medium of claim 13, wherein sensing is performed by one of a linear-optical sensor, a charge-coupled device sensor, and a Complementary Metal Oxide Semiconductor sensor.

16. The computer-readable medium of claim 13, wherein the air flow adjustment is one of an increase in air pressure and a burst of air.

17. The computer-readable medium of claim 13, wherein sensing the sheet separation is performed by measuring one of gaps between sheets of media in the media stack and thickness of the sheets of media in the media stack.

18. The computer-readable medium of claim 13, wherein the image production device is one of a copier, a printer, a facsimile device, and a multi-function device.

* * * * *